US005518357A

United States Patent [19]

Ziaylek Jr.

[11] Patent Number: 5,518,357

[45] Date of Patent: May 21, 1996

[54] RETAINING AND RETRIEVAL APPARATUS FOR STORAGE OF A LADDER UPON A VEHICLE SHELF AREA

[75] Inventor: Theodore Ziaylek, Jr., 140 Riverview Dr., Michael P. Ziaylek, 15 Cold Spring Ave., both of Yardley, Pa. 19067

[73] Assignees: Theodore Ziaylek, Jr.; Michael P. Ziaylek, both of Yardley, Pa.

[21] Appl. No.: 274,530

[22] Filed: Jul. 13, 1994

[51] Int. Cl.[6] ..... E06C 5/00

[52] U.S. Cl. ..... 414/462; 182/127

[58] Field of Search ..... 414/462, 680; 182/127; 224/548, 553

[56] References Cited

U.S. PATENT DOCUMENTS

| | | | |
|---|---|---|---|
| 2,080,527 | 5/1937 | Bixel . | |
| 2,492,841 | 12/1949 | Barkey . | |
| 2,586,531 | 2/1952 | Gordon . | |
| 2,946,397 | 7/1960 | Berberich . | |
| 2,966,275 | 12/1960 | Breekins . | |
| 3,013,681 | 12/1961 | Garnett . | |
| 3,058,607 | 10/1962 | Kiley . | |
| 3,123,178 | 3/1964 | Monagham et al. | 182/127 |
| 3,720,334 | 3/1973 | Permut et al. . | |
| 3,823,839 | 7/1974 | Petzing et al. . | |
| 3,963,136 | 6/1976 | Spanke . | |
| 4,008,838 | 2/1977 | Correll . | |
| 4,170,331 | 10/1979 | Faulstich . | |
| 4,243,120 | 1/1981 | Pratt, Jr. et al. . | |
| 4,262,834 | 4/1981 | Nutt . | |
| 4,408,680 | 10/1983 | Ross . | |
| 4,439,086 | 3/1984 | Thede . | |
| 4,751,981 | 6/1988 | Mitchell et al. . | |
| 4,827,742 | 5/1989 | McDonald . | |
| 4,844,490 | 7/1989 | Kohler . | |
| 4,877,108 | 10/1989 | Griffin et al. . | |
| 4,887,750 | 12/1989 | Dainty . | |
| 4,953,757 | 9/1990 | Stevens et al. . | |
| 5,009,350 | 4/1991 | Schill et al. . | |
| 5,048,641 | 9/1991 | Holcomb et al. . | |
| 5,058,791 | 10/1991 | Henriquez et al. . | |
| 5,104,280 | 4/1992 | Ziaylek et al. . | |
| 5,172,952 | 12/1992 | Lasnetski . | |
| 5,186,588 | 2/1993 | Sutton et al. | 182/127 |
| 5,209,628 | 5/1993 | Hassell | 414/462 |
| 5,398,778 | 3/1995 | Sexton | 182/127 |
| 5,421,495 | 6/1995 | Bubik et al. | 414/462 |

*Primary Examiner*—Michael S. Huppert
*Assistant Examiner*—Gregory A. Morse
*Attorney, Agent, or Firm*—Sperry, Zoda & Kane

[57] ABSTRACT

An apparatus for allowing storage of a ladder vertically above a shelf area defined on a vehicle while allowing powered movement of the apparatus to the retrieval position laterally adjacent the vehicle shelf area to easily allow removal of the ladder is disclosed. The design includes a U-shaped ladder holding bracket for holding the upper area of the ladder and a loop-shaped lower retaining bracket to allow the legs of the ladder to extend therein for securement. The retaining apparatus is mounted by a plurality of brackets and link arms to easily allow movement between the retrieval and the storage position. These arms also maintain the upper area of the ladder above the lower portion of the ladder such that it easily avoids contact with structures normally associated with the front of a vehicle such as the cab height, rearview mirrors, doors, etc. In this manner a ladder held in the storage position would be maintained in an inclined orientation. This inclined orientation further facilitates securement of the ladder by allowing the legs to extend into the loop retaining openings and only requires fixed securement on the bracket holding the upper area of the ladder thereby simplifying the design and yet achieving full efficiency and securement.

20 Claims, 4 Drawing Sheets

RETAINING AND RETRIEVAL APPARATUS FOR STORAGE OF A LADDER UPON A VEHICLE SHELF AREA

BACKGROUND OF THE INVENTION

1. Field of the Invention

The present invention deals with the field of devices for retaining objects with respect to the vehicles. More particularly the present invention is useful for retaining of ladders with respect to utility trucks. Even more specifically the present invention is useful for retaining ladders with respect to utility truck shelf areas often defined on such vehicles for retaining of utilitarian items secured thereto such as ladders and the like. The present invention provides a novel means for retaining of a ladder in a storage position above the vehicle utility shelf and allowing powered movement of the ladder to a horizontally lateral position from the vehicle shelf for facilitating removal therefrom.

2. Description of the Prior Art

Prior art devices have been utilized for maintaining utilitarian items with respect to utility trucks and for facilitating access thereto such as shown in U.S. Pat. No. 2,080,527 patented May 18, 1937 to E. Bixel and assigned to American Telephone and Telegraph Company on a "Ladder Holder"; and U.S. Pat. No. 2,492,841 patented Dec. 27, 1949 to C. Burkey on a "Pivoted Counterbalanced Car Top Carrier"; and U.S. Pat. No. 2,586,531 patented Feb. 19, 1952 to D. Gordon on a "Wheeled Support Having Ladder Assembly"; and U.S. Pat. No. 2,946,397 patented Jul. 26, 1960 to W. Berberich on a "Ladder Mount For Vehicles"; and U.S. Pat. No. 2,966,275 patented Dec. 27, 1960 to R. Brookins and assigned to Essick Manufacturing Company on an "Equipment Carrier"; and U.S. Pat. No. 3,013,681 patented Dec. 19, 1961 to E. Garnett on a "Device For Storage Of Elongated Articles On A Vehicle"; and U.S. Pat. No. 3,058,607 patented Oct. 16, 1962 to J. Kiley and assigned to James A. Kiley Company on "Ladder Racks"; and U.S. Pat. No. 3,720,334 patented Mar. 13, 1973 to A. Permut et al on "Boat And Equipment Loading Systems"; and U.S. Pat. No. 3,823,839 patented Jul. 16, 1974 to R. Petzing et al on a "Cartop Carrier Elevator"; and U.S. Pat. No. 3,963,136 patented Jun. 15, 1976 to T. Spanke on a "Retractable Ladder Rack"; and U.S. Pat. No. 4,008,838 patented Feb. 22, 1977 to R. Correll on a "Ladder Rack"; and U.S. Pat. No. 4,170,331 patented Oct. 9, 1979 to E. Faulstich on a "Vehicle Ladder Rack"; and U.S. Pat. No. 4,243,120 patented Jan. 6, 1981 to D. Pratt, Jr. et al and assigned to Harnischfeger Corporation on a "Retractable Boarding Ladder"; and U.S. Pat. No. 4,262,834 patented Apr. 21, 1981 to W. Nutt and assigned to Teledyne Canada, Limited on a "Ladder Rack"; and U.S. Pat. No. 4,408,680 patented Oct. 11, 1983 to D. Ross on a "Ladder Support Assembly"; and U.S. Pat. No. 4,439,086 patented Mar. 27, 1984 to R. Thede on a "Boat Loader"; and U.S. Pat. No. 4,751,981 patented Jun. 21, 1988 to J. Mitchell et al on a "Detachably Mounted Ladder Rack"; and U.S. Pat. No. 4,827,742 patented May 9, 1989 to R. McDonald and assigned to Unistrut Australia Pty. Ltd. on a "Security Assembly For Vehicle Roofrack"; and U.S. Pat. No. 4,844,490 patented Jul. 4, 1989 to R. Kohler on a "Fire Truck Ladder Support"; and U.S. Pat. No. 4,877,108 patented Oct. 31, 1989 to L. Griffin et al on a "Hydraulic Ladder Brace"; and U.S. Pat. No. 4,887,750 patented Dec. 19, 1989 to R. Dainty and assigned to British Gas plc on a "Rack Arrangement"; and U.S. Pat. No. 4,953,757 patented Sep. 4, 1990 to J. Stevens et al on a "Front Rack For A Truck"; and U.S. Pat. No. 5,009,350 patented Apr. 23, 1991 to J. Schill et al on "Retainer Assemblies For Elongated Objects"; and U.S. Pat. No. 5,048,641 patented Sep. 17, 1991 to J. Holcomb et al and assigned to Jack N. Holcomb on a "Van-Mounted Ladder Assembly With Concealed Radil Antennas"; and U.S. Pat. No. 5,058,791 patented Oct. 22, 1991 to K. Henriquez et al and assigned to Slide-out, Inc. on a "Vehicular Ladder Rack"; and U.S. Pat. No. 5,104,280 patented Apr. 14, 1992 to M. Ziaylek et al and assigned to Michael P. Ziaylek on an "Apparatus For Use With An Emergency Vehicle For Storage And Retrieval Of Remotely Located Emergency Devices"; and U.S. Pat. No. 5,172,952 patented Dec. 22, 1992 to R. Lasnetski on an "Overhead Storage Rack For Storing Ladders Or The Like".

SUMMARY OF THE INVENTION

The present invention provides an apparatus which is useful for retaining and retrieval of a ladder for storage and access thereto with respect to a vehicle shelf area wherein the ladder includes an upper area as well as two downwardly extending legs on at least one end thereof. The construction includes a primary mounting bracket which is fixedly secured to the vehicle shelf area and includes a base plate itself which is fixedly secured to the vehicle shelf. A first securement post extends upwardly from the base plate. A second securement post also extends upwardly from the base plate to a height higher than the first securement post.

A primary link arm is pivotally secured to the first securement post and extends outwardly therefrom. A longitudinally extensible arm is pivotally secured to the second securement post and extends outwardly therefrom. The longitudinally extensible arm is pivotally secured to the second securement post at a position above the point of securement of the primary link arm with respect to the first securement post to aid in facilitating pivotal movement thereof. The longitudinally extensible arm is movable between a contracted position with the ladder in the storage position and an extended position with the ladder in the retrieval position.

A primary support bracket is pivotally secured to the primary link arm and is pivotally secured to the longitudinally extensible arm to be movable therewith.

A primary ladder retaining apparatus is designed to be attached to the primary support bracket and includes a U-shaped ladder holding bracket fixedly attached to the primary support bracket. This U-shaped ladder holding bracket is adapted to receive the upper area of a ladder therein for retainment thereof. This U-shaped ladder holding bracket is open in the upwardly facing direction with the ladder in the storage position. The U-shaped member includes a first strut member and a second strut member extending outwardly therefrom to define the U-shape thereof. The first strut member is longer than the second strut member to facilitate retainment of a ladder within the primary ladder retaining apparatus.

The primary ladder retaining apparatus further includes at least one resiliently biased retaining clamp which is resiliently mounted with respect to the U-shaped holding bracket for detachably engaging and securing a ladder therein. This resiliently biased retaining clamp preferably includes a handle for facilitating detachable securement thereof and a spring means to facilitate the resiliency in the clamping action.

A secondary mounting bracket may be fixedly secured to the vehicle shelf area at a location spatially disposed from the primary mounting bracket. A secondary link arm is pivotally secured with respect to this secondary mounting bracket and extends outwardly therefrom. The secondary link arm is preferably shorter in length than the primary link arm such as to maintain the ladder when retained in an inclined position relative to the vehicle shelf area with the upper area of the ladder further from the shelf area and the legs of the ladder closer to the shelf area.

A driveshaft may be included attached to the primary link arm at the location of securement thereof with respect to the primary mounting bracket and with respect to the secondary link arm at the location of securement thereof with respect to the secondary mounting bracket in order to facilitate pivotal movement of the secondary link arm responsive to pivotal movement of the primary link arm further responsive to extension and retraction of the longitudinal extension arm.

A secondary support bracket may be attached to the secondary link arm. A secondary ladder retaining apparatus may be secured with respect to the secondary support bracket in order to facilitate retaining of a ladder therein. This secondary ladder retaining apparatus includes two looped openings therein to receive the two downwardly extending legs of a ladder for retainment thereof. The two looped openings of the secondary ladder retaining apparatus is closer to the driveshaft than the U-shaped ladder holding bracket in order to hold the ladder in the retaining position inclined with respect to the vehicle shelf area.

A motor such as an electrical motor or the like may be fixedly secured with respect to the longitudinally extensible arm means and operatively connected thereto for powering between the storage position and the retrieval position as desired. Strengthening of the movable structures of the present invention may be enhanced by the inclusion of a primary angle bracket extending from the driveshaft to the primary link arm as well as a secondary angle bracket extending from the driveshaft to the secondary link arm. These two angularly oriented brackets can significantly strengthen the overall design of the configuration of the present invention.

It is an object of the present invention to provide a retaining and retrieval apparatus for storage of a ladder upon a vehicle shelf area wherein ladders and other similarly shaped emergency devices can be conveniently stored in a remote location and retrieved immediately when needed.

It is an object of the present invention to provide a retaining and retrieval apparatus for storage of a ladder upon a vehicle shelf area wherein maintenance costs are minimized.

It is an object of the present Invention to provide a retaining and retrieval apparatus for storage of a ladder upon a vehicle shelf area wherein requirements for maintenance are minimized.

It is an object of the present invention to provide a retaining and retrieval apparatus for storage of a ladder upon a vehicle shelf area wherein initial capital outlay for equipment is minimal.

It is an object of the present invention to provide a retaining and retrieval apparatus for storage of a ladder upon a vehicle shelf area wherein the number of moving parts is minimized.

It is an object of the present invention to provide a retaining and retrieval apparatus for storage of a ladder upon a vehicle shelf area wherein powering of the retrieval device can be by automatic electrical power.

It is an object of the present invention to provide a retaining and retrieval apparatus for storage of a ladder upon a vehicle shelf area wherein quick and efficient retrieval is achievable.

It is an object of the present invention to provide a retaining and retrieval apparatus for storage of a ladder upon a vehicle shelf area wherein two retaining brackets are used with a separately operated securement means only on one bracket.

It is an object of the present invention to provide a retaining and retrieval apparatus for storage of a ladder upon a vehicle shelf area wherein the ladder is maintained in an inclined position to facilitate retaining thereof by providing loop brackets around the legs thereof.

It is an object of the present invention to provide a retaining and retrieval apparatus for storage of a ladder upon a vehicle shelf area wherein the storage position is vertically above a vehicle shelf area and the retrieval position is laterally adjacent the vehicle shelf area.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
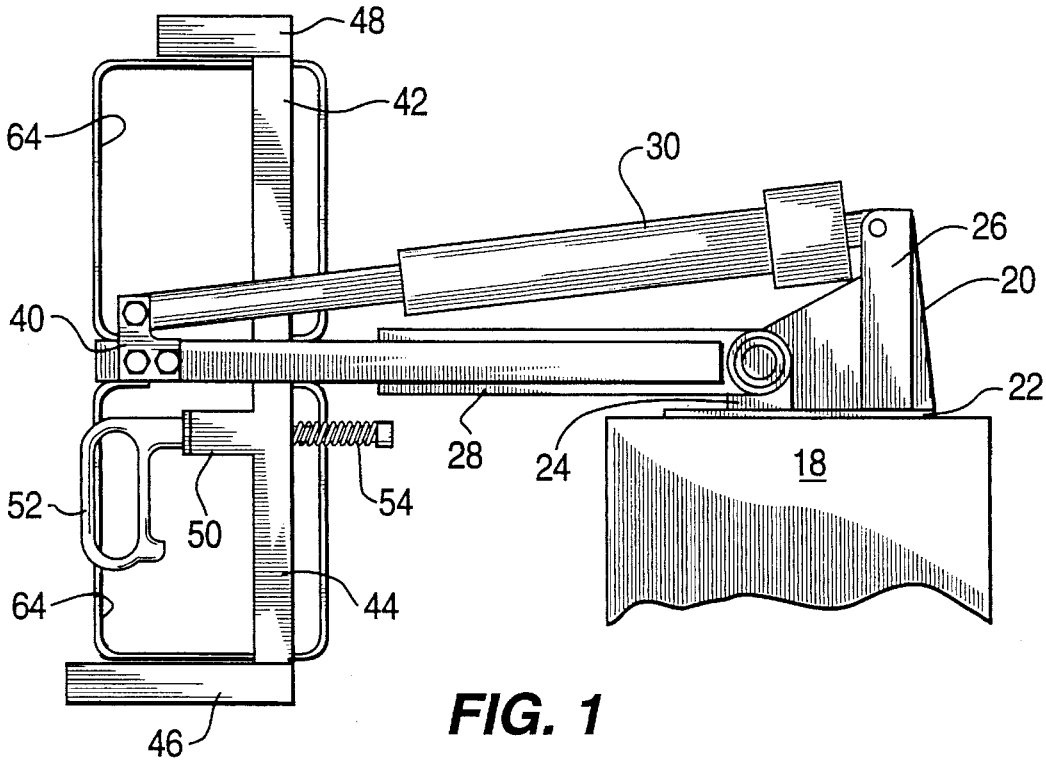
FIG. 1 is a side plan view of an embodiment of the retaining and retrieval apparatus of the present invention shown in the retrieval position.

The present invention provides a retaining and retrieval apparatus for storage and retrieval of a ladder 10 with respect to a vehicle shelf area 18 defined upon a vehicle 16. Such utility vehicles 16 commonly include vehicle shelves 18 for various utilitarian purposes. The present invention provides a means for storing and providing access to a ladder 10 pivotally secured with respect to such a vehicle shelf 18. Such a ladder normally includes an upper area 12 and includes two downwardly extending legs 14 on at least one end thereof.

The apparatus preferably includes a primary mounting bracket 20. Bracket 20 preferably comprises a base plate means 22 which is adapted to be secured directly the vehicle shelf 18. A first securement post 24 is fixedly secure or integral with respect to the base plate 22 and extends outwardly therefrom. Similarly a second securement post 26 may be fixedly secured to the base plate means 22 or more preferably integral therewith and can extend outwardly therefrom.

A primary link arm 28 is adapted to be pivotally secured with respect to the first securement post 24 and extend outwardly therefrom. A longitudinally extensible arm 30 which may be an arm capable of powered telescoping movement is preferably pivotally secured with respect to the second securement post 26. In this preferred embodiment second securement post 26 is longer than first securement post 24 thereby allowing the point of pivotal securement of the longitudinal extensible arm 30 to be at a position further from the vehicle shelf 18 than the point of pivotal point of securement of the primary link arm 28.

The present invention further includes a primary support bracket 40 which is preferably pivotally secured with respect to the primary link arm 28 and the longitudinally extensible arm 30 at the end opposite from the primary mounting bracket 20. Primary support bracket 40 includes the primary ladder retaining apparatus 42 fixedly secured thereto for retaining of the upper area 12 of ladder 10.

Figure 2:
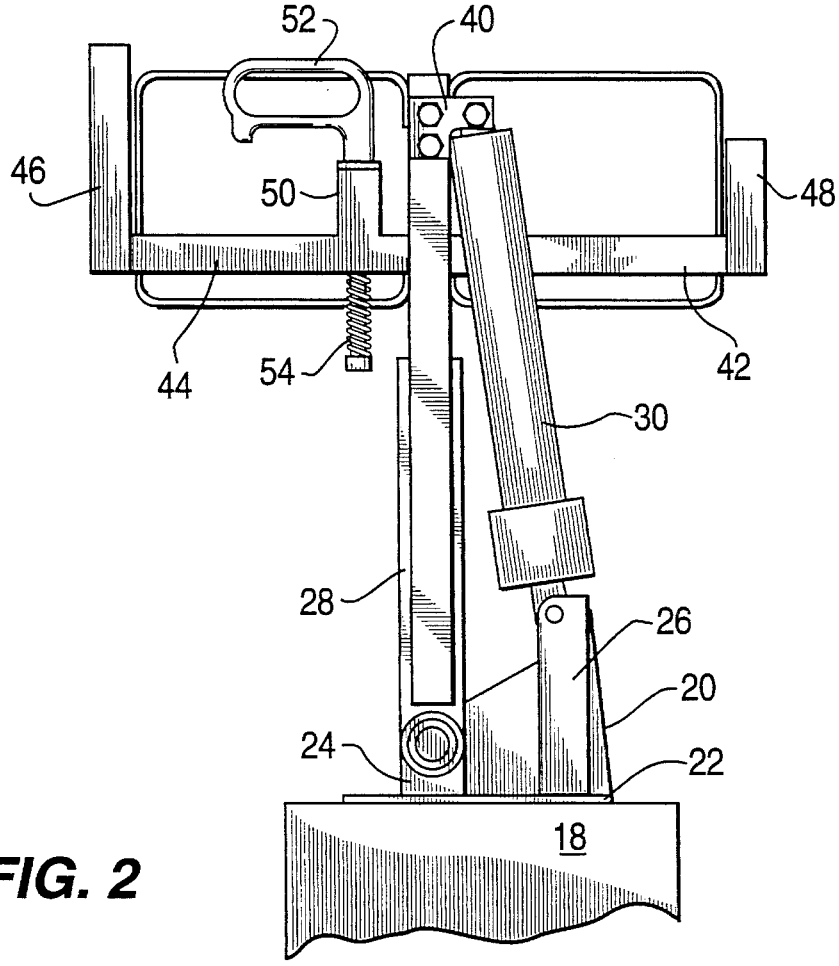
FIG. 2 is an illustration of the embodiment shown in FIG. 1 in the retaining or storage position.
Figure 3:
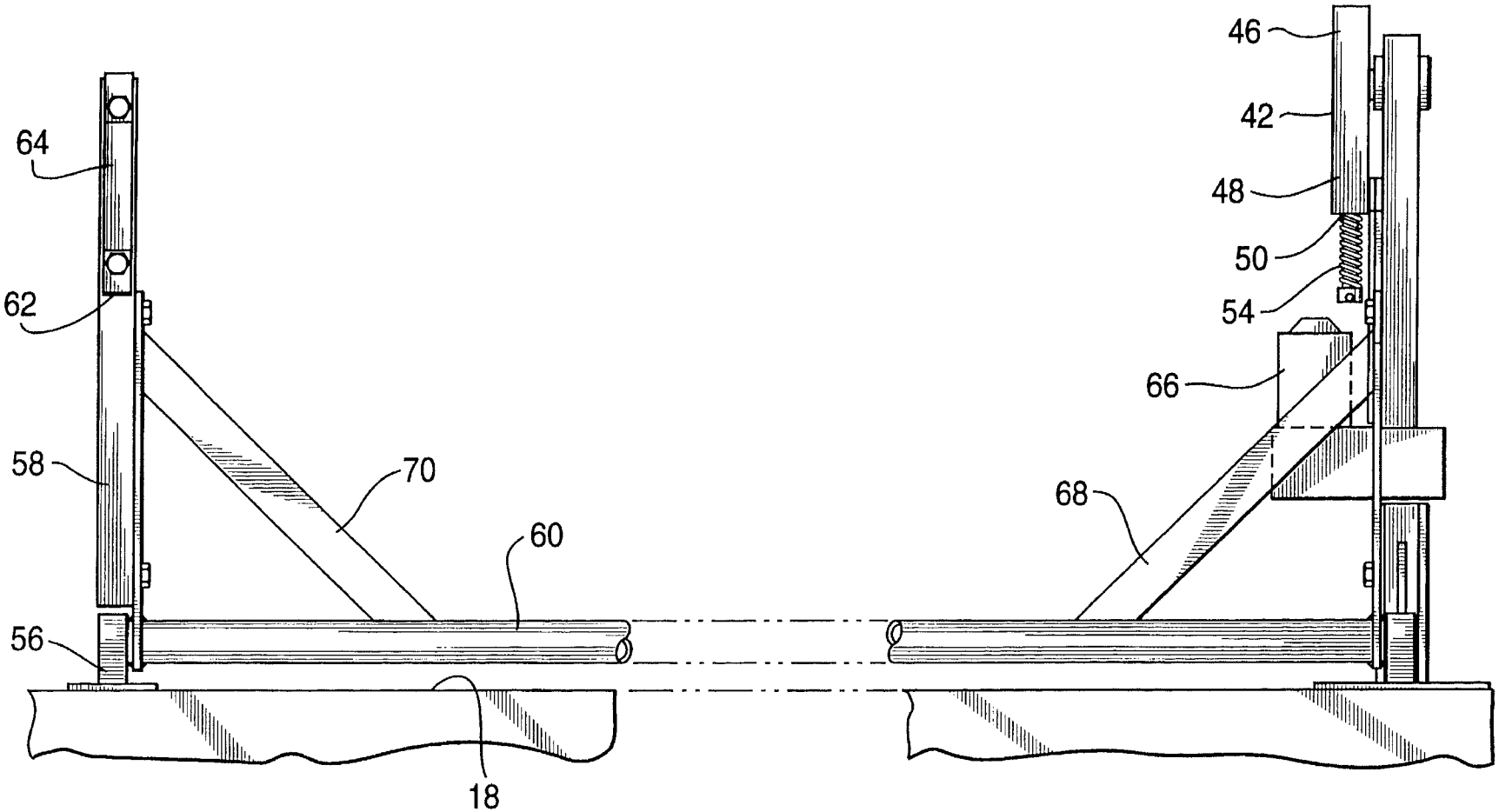
FIG. 3 is a front plan view of an embodiment of the apparatus of the present invention shown in the storage position.
Figure 4:
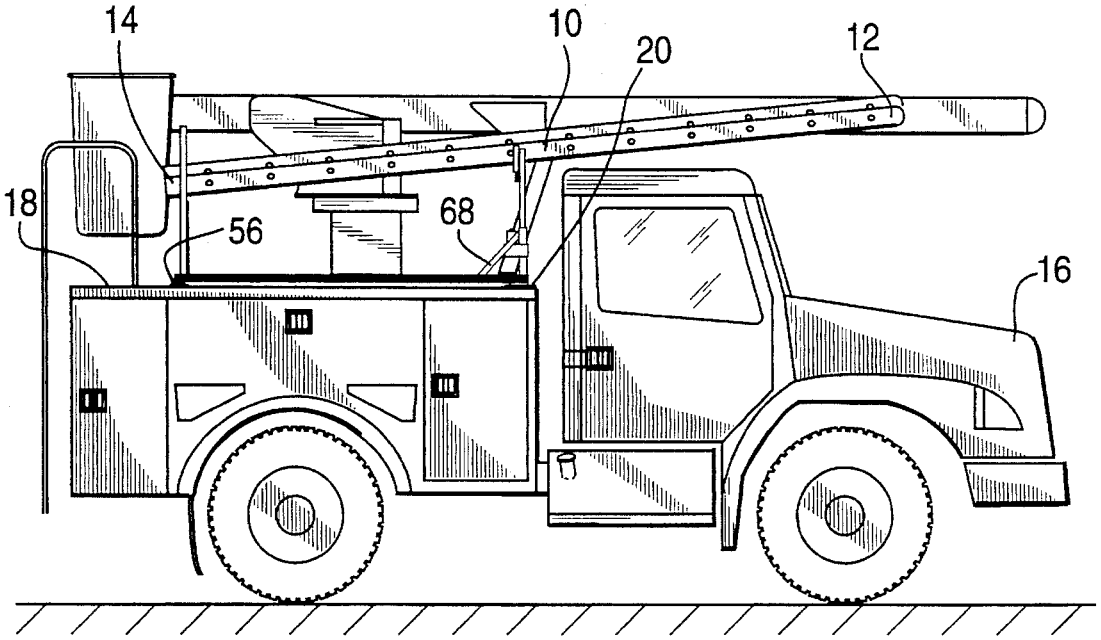
FIG. 4 is a side plan view of an embodiment of a vehicle having a vehicle shelf area showing the apparatus in the storage position.
Figure 5:
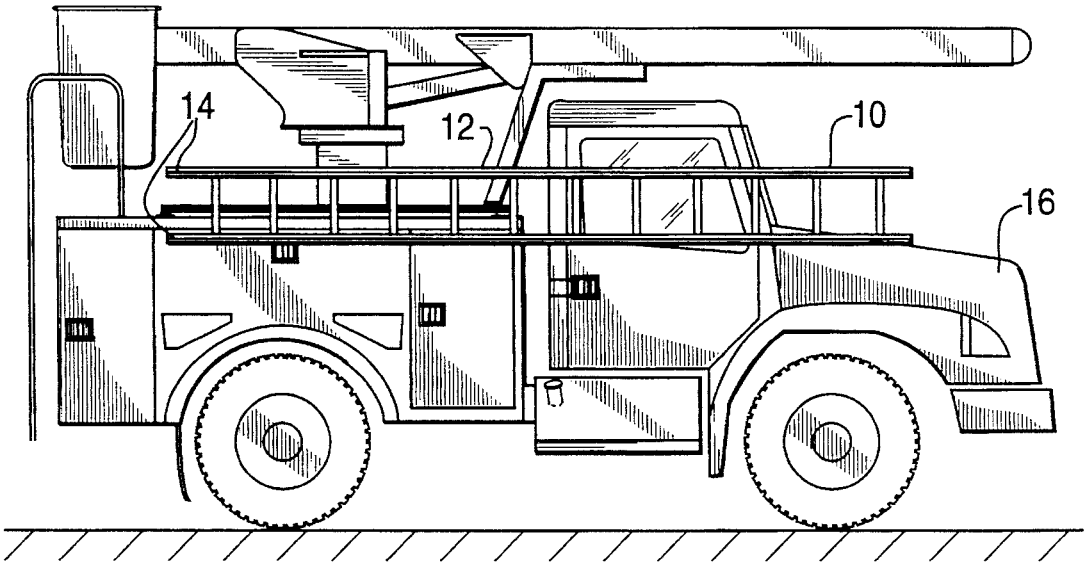
FIG. 5 is an illustration of the embodiment shown in FIG. 4 with the ladder in the retrieval position.
Figure 6:
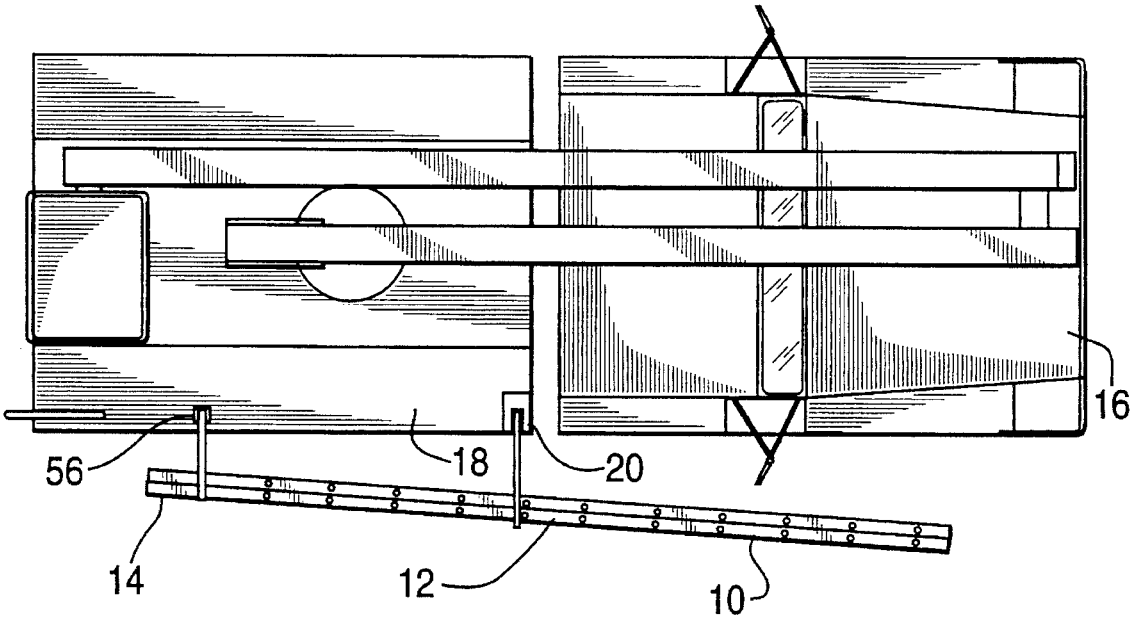
FIG. 6 is a top plan view of the embodiment and positioning of FIG. 5.
Figure 7:
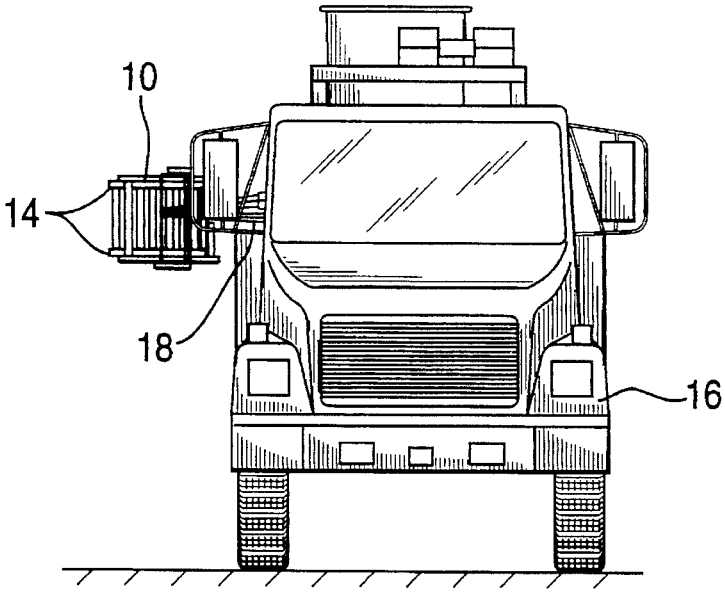
FIG. 7 is a front plan view of the embodiment and ladder position shown in FIG. 5.

The primary ladder retaining apparatus 42 preferably comprises a U-shaped ladder holding bracket 44 as shown best in FIGS. 1 and 2. This U-shaped ladder holding bracket 44 will include a first strut member 46 and a second strut member 48 extending upwardly parallel with respect to one another to form the U-shape of the holding bracket 44. Preferably the first strut member 46 is somewhat longer to facilitate retainment of the ladder 10 with respect thereto. While ladder retaining loops 64 appear in FIGS. 1 and 2, they are attached at the secondary support bracket 62 rather than the primary support bracket 40. The two elements are aligned in the end views of FIGS. 1 and 2; the numbering refers to the primary support bracket.

A resiliently biased retaining clamp 50 is movably positioned with respect to the primary ladder retaining apparatus 42. This retaining clamp includes a handle 52 and a spring means 54 preferably. By pulling outwardly on the handle 52 the clamp will move outwardly allowing it to be positioned extending about a rung or side section of the ladder to facilitate retaining thereof within the U-shaped ladder holding bracket 44.

The apparatus of the present invention further includes a secondary mounting bracket 56 fixedly attached to the vehicle shelf 18 at a location remote from the point of attachment of the primary mounting bracket 20. A secondary link arm 58 is pivotally secured to the secondary mounting bracket 56 in a similar manner to the pivotal securement of the primary link arm 28 with respect to the primary mounting bracket 20. The secondary link arm 58 extends outwardly from the secondary mounting 56. The concept of the present invention transmits power from the movement of the primary mounting bracket 20 through the driveshaft means 60. Driveshaft means 60 is preferably connected between the secondary link arm 58 and the primary link arm 28. Driveshaft means 60 is preferably secured to the secondary link arm 58 at the point of pivotal attachment thereof with respect to the secondary bracket 56 such as to be rotatable therewith for transmitting power thereto. Similarly the driveshaft means 60 is preferably connected to the primary link arm 28 at the point of pivotal securement thereof with respect to the primary mounting bracket 20 for receiving power therefrom responsive to extension or contraction of the longitudinal extension arm means 30.

The secondary link arm 58 will include a secondary support bracket 62 secured to the end thereof opposite from the secondary mounting bracket 56. Secondary support bracket 62 includes a plurality of looped openings 64 therein for receiving the two downwardly extending legs 14 of a ladder 10 for securement therein.

Powering of contraction or extension of the longitudinally extensible arm means 30 is achieved by way of a motor means 66 which is preferably an electrically powered motor means which can be mounted directly to the longitudinally extensible arm means 30.

Under heavy operating loads additional structural strength is required in the apparatus of the present invention and for this purpose a primary angle bracket means 68 can optionally be included as well as a secondary angle bracket means 70. Primary angle bracket means 68 extends from the driveshaft 60 to the primary link arm 28 for structural strengthening thereof. In a similar manner the secondary angle bracket 70 extends from the driveshaft 60 to the secondary link arm 58 to facilitate strengthening thereof.

The operation of the motor means 66 is designed to longitudinally extend or contract the extensible arm means 30. The longitudinally extensible arm means 30 is shown in the extended position 36 in FIG. 1. Extensible arm means 30 is shown in the contracted position 32 in FIG. 2. The contracted position 32 corresponds to the storage position 34 for the ladder 10 whereas the extended position 36 corresponds to the retrieval position 38 for the ladder 10. In the storage position as shown in FIG. 2 the U-shaped ladder holding bracket 44 will face in an upwardly direction and would be positioned above the vehicle shelf area 18. With the extensible arm means 30 in the extended position 36 the ladder 10 will be in the retrieval position 38 as shown in FIG. 1 to allow for easy removal thereof merely by releasing of the resiliently biased retaining clamp 50.

One of the unique aspects of the present invention is the ability to hold a rather bulky and heavy item such as a ladder by the use of a single retaining clip. This is achieved by the combination of usage of looped openings 64 in the secondary support bracket 62 into which the two downwardly extending legs 14 of the ladder 10 can be placed. After placing of these legs 14 into these looped openings 64 the upper portion of the ladder is placed in abutment with respect to the U-shaped ladder holding bracket 44 and the biased retaining clamps 50 are engaged to detachably secure the upper area 12 of ladder 10 with respect to the U-shaped bracket 44. Thus, merely by use of a single retaining clamp and the careful choice of configurations of the retaining brackets, the ladder can be retained. The ladder is also easily accessible because of the construction of the link arms and the longitudinally extendable member of the present invention primarily because of the orientation of the ladder in an inclined position such that when the ladder moves upwardly and downwardly along with the apparatus between the storage position 34 and the retrieval position 38 the additional spacing is provided adjacent the cab of the vehicle in order to prevent contact of the ladder or the apparatus with respect to the cab area or window areas or door areas or rearview mirror areas. All of these items need to be cleared during movement of the ladder storage apparatus between the storage position and the retrieval position. This is made possible by this novel inclined orientation. Also this novel inclined orientation provides the means for allowing retaining of the ladder by a single resilient clamp. This combination is unique and is made possible by the looped configuration of the opening 64. The upper area 12 of the ladder 10 refers to any portion of the ladder above the two downwardly extending legs 14.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A retaining and retrieval apparatus for storage and retrieval of a ladder having an upper area and two downwardly extending legs upon a vehicle shelf area comprising:

A. a primary mounting bracket fixedly secured to a vehicle shelf area and including:

(1) a base plate fixedly secured to the vehicle shelf area;

(2) a first securement post extending upwardly from said base plate;

(3) a second securement post extending upwardly from said base plate higher than said first securement post means extends therefrom;

B. a primary link arm pivotally secured to said first securement post and extending outwardly therefrom;

C. a longitudinally extensible arm pivotally secured to said second securement post and extending outwardly therefrom, said longitudinally extensible arm being moveable between a contracted position with the ladder in the storage position and an extended position with the ladder in the retrieval position;

D. a primary support bracket pivotally secured to said primary link arm and pivotally secured to said longitudinally extensible arm to be moveable therewith;

E. a primary ladder retaining apparatus attached to said primary support bracket and comprising:

(1) a U-shaped ladder holding bracket fixedly attached to said primary support bracket and adapted to receive the upper area of a ladder therein for retainment, said U-shaped ladder holding bracket being open in the upwardly facing direction with the ladder in the storage position;

(2) at least one resiliently biased retaining clamp resiliently mounted with respect to said U-shaped holding bracket to detachably engage and secure a ladder with respect thereto;

F. a secondary mounting bracket fixedly secured to a vehicle shelf area in a location spatially disposed from said primary mounting bracket;

G. a secondary link arm pivotally secured with respect to said secondary mounting bracket and extending outwardly therefrom;

H. a driveshaft attached to said primary link arm and said secondary link arm to facilitate pivotal movement of said secondary link arm responsive to pivotal movement of said primary link arm responsive to extension and retraction of said longitudinally extensible arm;

I. a secondary support bracket attached to said secondary links arm; and

J. a secondary ladder retaining apparatus secured to said secondary support bracket to facilitate retaining of a ladder therein, said secondary ladder retaining apparatus including two looped openings therein to receive the two downwardly extending legs of a ladder therein for retainment thereof, said two looped openings of said secondary ladder retaining apparatus being closer to said driveshaft than said U-shaped ladder holding bracket to hold the ladder in the retaining position inclined with respect to the vehicle shelf area.

2. A retaining and retrieval apparatus for storage and retrieval of a ladder having an upper area and two downwardly extending legs upon a vehicle shelf as defined in claim 1 wherein said longitudinally extensible arm is pivotally secured to said second securement post at a location above the point of securement of said primary link arm to said first securement post to facilitate pivotally movement thereof.

3. A retaining and retrieval apparatus for storage and retrieval of a ladder having an upper area and two downwardly extending legs upon a vehicle shelf as defined in claim 1 further including a motor means operatively secured to said longitudinally extensible arm for providing power for extending and retracting thereof.

4. A retaining and retrieval apparatus for storage and retrieval of a ladder having an upper area and two downwardly extending legs upon a vehicle shelf as defined in claim 3 wherein said motor means is electrical.

5. A retaining and retrieval apparatus for storage and retrieval of a ladder having an upper area and two downwardly extending legs upon a vehicle shelf as defined in claim 3 wherein said motor means is attached to said longitudinally extensible arm to facilitate driving thereof.

6. A retaining and retrieval apparatus for storage and retrieval of a ladder having an upper area and two downwardly extending legs upon a vehicle shelf as defined in claim 1 wherein the ladder is retained in the storage position above the vehicle shelf area inclined with the upper area of the ladder further from the vehicle shelf area.

7. A retaining and retrieval apparatus for storage and retrieval of a ladder having an upper area and two downwardly extending legs upon a vehicle shelf as defined in claim 1 wherein said resiliently biased retaining clamp includes a handle means to facilitate engagement thereof with respect to a ladder positioned within said U-shaped ladder holding bracket.

8. A retaining and retrieval apparatus for storage and retrieval of a ladder having an upper area and two downwardly extending legs upon a vehicle shelf as defined in claim 1 wherein said driveshaft is secured to said secondary link arm at the location of securement thereof with respect to said secondary mounting bracket to facilitate pivotal movement thereof.

9. A retaining and retrieval apparatus for storage and retrieval of a ladder having an upper area and two downwardly extending legs upon a vehicle shelf as defined in claim 1 wherein said driveshaft is secured to said primary link arm at the location of securement thereof with respect to said primary mounting bracket to facilitate pivotal movement thereof.

10. A retaining and retrieval apparatus for storage and retrieval of a ladder having an upper area and two downwardly extending legs upon a vehicle shelf as defined in claim 1 further comprising a primary angle bracket extending from said driveshaft to said primary link arm for structural strengthening thereof.

11. A retaining and retrieval apparatus for storage and retrieval of a ladder having an upper area and two downwardly extending legs upon a vehicle shelf as defined in claim 1 further comprising a secondary angle bracket extending from said driveshaft to said secondary link arm for structural strengthening thereof.

12. A retaining and retrieval apparatus for storage and retrieval of a ladder having an upper area and two downwardly extending legs upon a vehicle shelf as defined in claim 1 wherein said U-shaped ladder holding bracket is open in a laterally facing direction with the ladder in the retrieval position.

13. A retaining and retrieval apparatus for storage and retrieval of a ladder having an upper area and two downwardly extending legs upon a vehicle shelf as defined in claim 1 wherein said primary ladder retaining apparatus and said secondary ladder retaining apparatus are positioned laterally adjacent the vehicle shelf area with the ladder in the retrieval position.

14. A retaining and retrieval apparatus for storage and retrieval of a ladder having an upper area and two downwardly extending legs upon a vehicle shelf as defined in claim 1 wherein said primary ladder retaining apparatus and said secondary ladder retaining apparatus are positioned vertically above the vehicle shelf area with the ladder in the storage position.

15. A retaining and retrieval apparatus for storage and retrieval of a ladder having an upper area and two downwardly extending legs upon a vehicle shelf as defined in claim 1 wherein said secondary link arm is shorter in length than said primary link arm to facilitate positioning of said secondary ladder retaining apparatus closer to the vehicle shelf area than said primary ladder retaining apparatus.

16. A retaining and retrieval apparatus for storage and retrieval of a ladder having an upper area and two downwardly extending legs upon a vehicle shelf as defined in claim 1 wherein said resiliently biased retaining clamp includes a spring to facilitate detachable securement of a ladder within said U-shaped ladder holding bracket.

17. A retaining and retrieval apparatus for storage and retrieval of a ladder having an upper area and two downwardly extending legs upon a vehicle shelf as defined in claim 1 wherein said longitudinally extensible arm is positioned extending laterally outwardly and downwardly with respect to said second securement post with the ladder positioned in the retrieval position.

18. A retaining and retrieval apparatus for storage and retrieval of a ladder having an upper area and two downwardly extending legs upon a vehicle shelf as defined in claim 1 wherein said U-shaped member includes a first strut member and a second strut member extending outwardly therefrom to define the U-shape thereof.

19. A retaining and retrieval apparatus for storage and retrieval of a ladder having an upper area and two downwardly extending legs upon a vehicle shelf as defined in claim 18 wherein said first strut member is longer than said second strut member to facilitate retaining of a ladder by said U-shaped ladder holding bracket.

20. A retaining and retrieval apparatus for storage and retrieval of a ladder having an upper area and two downwardly extending legs upon a vehicle shelf area comprising:

A. a primary mounting bracket fixedly secured to a vehicle shelf area and including:
   (1) a base plate fixedly secured to the vehicle shelf area;
   (2) a first securement post extending upwardly from said base plate;
   (3) a second securement post extending upwardly from said base plate higher than said first securement post extends therefrom;

B. a primary link arm pivotally secured to said first securement post and extending outwardly therefrom;

C. a longitudinally extensible arm pivotally secured to said second securement post and extending outwardly therefrom, said longitudinally extensible arm being pivotally secured to said second securement post at a position above the point of securement of said primary link arm with respect to said first securement post to facilitate pivotal movement thereof, said longitudinally extensible arm being moveable between a contracted position with the ladder in the storage position and an extended position with the ladder in the retrieval position;

D. a primary support bracket pivotally secured to said primary link arm and pivotally secured to said longitudinally extensible arm to be moveable therewith;

E. a primary ladder retaining apparatus attached to said primary support bracket and comprising:
   (1) a U-shaped ladder holding bracket fixedly attached to said primary support bracket and adapted to receive the upper area of a ladder therein for retainment, said U-shaped ladder holding bracket being open in the upwardly facing direction with the ladder in the storage position, said U-shaped member including a first strut member and a second strut member extending outwardly therefrom to define the U-shape thereof, said first strut member being longer than said second strut member to facilitate retainment of a ladder within said primary ladder retaining apparatus;
   (2) at least one resiliently biased retaining clamp resiliently mounted with respect to said U-shaped holding bracket to detachably engage and secure a ladder with respect thereto, said resiliently biased retaining clamp including a handle to facilitate securing of a ladder therewith, said resiliently biased retaining clamp further including a spring to facilitate resilient clamping therewith;

F. a secondary mounting bracket fixedly secured to a vehicle shelf area in a location spatially disposed from said primary mounting bracket;

G. a secondary link arm pivotally secured with respect to said secondary mounting bracket and extending outwardly therefrom, said secondary link arm being shorter in length than said primary link arm to maintain a ladder in an inclined position relative to the vehicle shelf area;

H. a driveshaft attached to said primary link arm at the location of securement thereof with respect to said primary mounting bracket and with respect to said secondary link arm at the location of securement thereof with respect to said secondary mounting bracket to facilitate pivotal movement of said secondary link arm responsive to pivotal movement of said primary link arm responsive to extension and retraction of said longitudinally extensible arm;

I. a secondary support bracket attached to said secondary links arm;

J. a secondary ladder retaining apparatus secured to said secondary support bracket to facilitate retaining of a ladder therein, said secondary ladder retaining apparatus including two looped openings therein to receive the two downwardly extending legs of a ladder therein for retainment thereof, said two-looped openings of said secondary ladder retaining apparatus being closer to said driveshaft than said U-shaped ladder holding bracket to hold the ladder in the retaining position inclined with respect to the vehicle shelf area;

K. an electrical motor means fixedly secured with respect to said longitudinally extensible arm and operatively connected thereto for powering thereof between the storage position and the retrieval position;

L. a primary angle bracket extending from said driveshaft to said primary link arm for structural strengthening thereof; and M. a secondary angle bracket extending from said driveshaft to said secondary link arm for structural strengthening thereof.

* * * * *

UNITED STATES PATENT AND TRADEMARK OFFICE

CERTIFICATE OF CORRECTION

PATENT NO. : 5,518,357

DATED : May 21, 1996

INVENTOR(S) : Michael Paul Ziaylek

It is certified that error appears in the above-identified patent and that said Letters Patent are hereby corrected as shown below:

At the top of the patent under "United States Patent" change "Ziaylek Jr." to -- Ziaylek --.

At [75] the inventors are listed incorrectly. There is only one inventor -- Michael Paul Ziaylek --.

In column 7, line 18, delete "means".

In column 10, line 56, delete "means".

Signed and Sealed this

Twenty-fourth Day of September, 1996

Bruce Lehman

*Attest:*

BRUCE LEHMAN

*Attesting Officer*

*Commissioner of Patents and Trademarks*